US008732862B1

(12) United States Patent
Shields

(10) Patent No.: US 8,732,862 B1
(45) Date of Patent: May 27, 2014

(54) EXERCISE GARMENT

(76) Inventor: Sherry Y. Shields, Memphis, TN (US)

( * ) Notice: Subject to any disclaimer, the term of this patent is extended or adjusted under 35 U.S.C. 154(b) by 1719 days.

(21) Appl. No.: 11/761,216

(22) Filed: Jun. 11, 2007

(51) Int. Cl.
*A41D 15/00* (2006.01)

(52) U.S. Cl.
USPC ..... 2/70

(58) Field of Classification Search
USPC ..... 2/70, 72, 76, 113, 115, 212, 221, 222, 2/227, 228, 237; 482/124
See application file for complete search history.

(56) References Cited

U.S. PATENT DOCUMENTS

| | | | | |
|---|---|---|---|---|
| 4,946,453 | A | 8/1990 | Monson | |
| 5,103,501 | A * | 4/1992 | Meisels | 2/113 |
| 5,136,727 | A * | 8/1992 | Brisco | 2/409 |
| 5,182,812 | A | 2/1993 | Goldsby | |
| 5,700,231 | A * | 12/1997 | Wilkinson | 482/124 |
| 5,778,452 | A | 7/1998 | Dicker et al. | |
| 5,842,959 | A | 12/1998 | Wilkinson | |
| 6,061,832 | A * | 5/2000 | Morrison, Jr. | 2/78.1 |
| 6,176,816 | B1 * | 1/2001 | Dicker et al. | 482/124 |
| 6,231,488 | B1 * | 5/2001 | Dicker et al. | 482/124 |
| D456,111 | S | 4/2002 | Fairhurst et al. | |
| 7,246,381 | B2 * | 7/2007 | Green | 2/69 |
| 2003/0106129 | A1 | 6/2003 | Kim | |

* cited by examiner

*Primary Examiner* — Amber Anderson

(57) ABSTRACT

An exercise garment for retaining heat around an abdomen, a lower back, and portions of a pelvic area and a buttocks of a person to help lose weight in those areas during a workout includes an upper garment section being positioned over a portion of an upper torso of the person when the upper garment section is worn. A waist constricting band is coupled to a bottom edge of the upper garment section to constrict against the skin and secure the upper garment section in position. A lower garment section is positioned over a lower torso and upper legs of the person and is coupled to the constricting band opposite the upper garment section. An interior panel is coupled to and extends between the upper garment section and the lower garment section. The interior panel extends over the areas to increase heat retention and sweating during the workout.

14 Claims, 3 Drawing Sheets

EXERCISE GARMENT

BACKGROUND OF THE INVENTION

1. Field of the Invention

The present invention relates to weight reducing athletic garments and more particularly pertains to a new weight reducing athletic garment for retaining heat around an abdomen, a lower back, a portion of a pelvic area and a portion of a buttocks of a person to help loose weight in those areas during a workout.

2. Description of the Prior Art

The use of weight reducing athletic garments is known in the prior art. While these devices fulfill their respective, particular objectives and requirements, the need remains for a system that has certain improved features that includes an interior panel positioned adjacent skin of a person to retain heat next to the skin and encourage sweating and weight loss. Additionally, the system should have the interior panel positioned around an abdominal area, a lower back, a portion of a pelvic area and a portion of buttocks to concentrate heat retention in these areas.

SUMMARY OF THE INVENTION

The present invention meets the needs presented above by generally comprising an upper garment section being positioned over a portion of an upper torso of a person when the upper garment section is worn. A waist constricting band is coupled to a bottom edge of the upper garment section. The waist constricting band constricts against the skin to secure the upper garment section in position on the upper torso. The waist constricting band is positioned around a waist of the person. A lower garment section is positioned over a lower torso and upper legs of the person when the lower garment section is worn by the person. An upper edge of the lower garment section is coupled to the constricting band opposite the upper garment section. An interior panel is coupled to and extends between the upper garment section and the lower garment section. The interior panel extends over an abdominal area and a lower back of the upper torso and a portion of a pelvic area and a portion of a buttocks of the lower torso to increase heat retention and increase sweating during the workout. The interior panel is positioned between the skin and the upper garment section and the lower garment section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
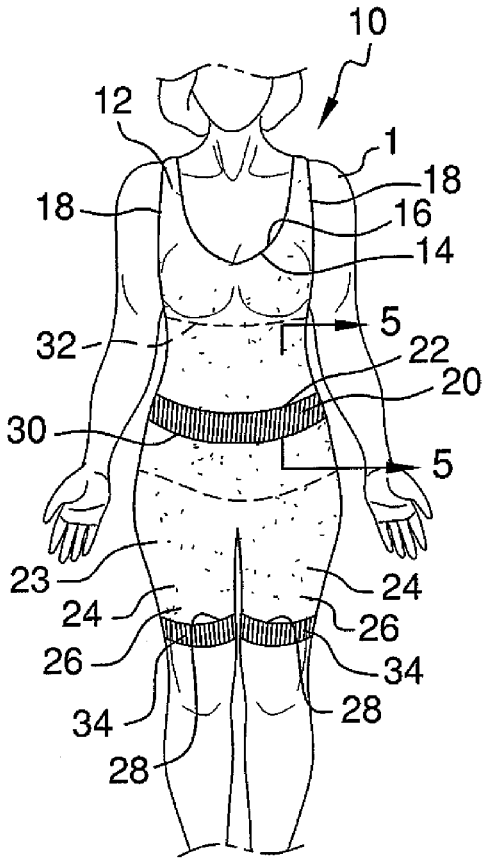
FIG. 1 is a front view of an exercise garment according to the present invention.
Figure 2:
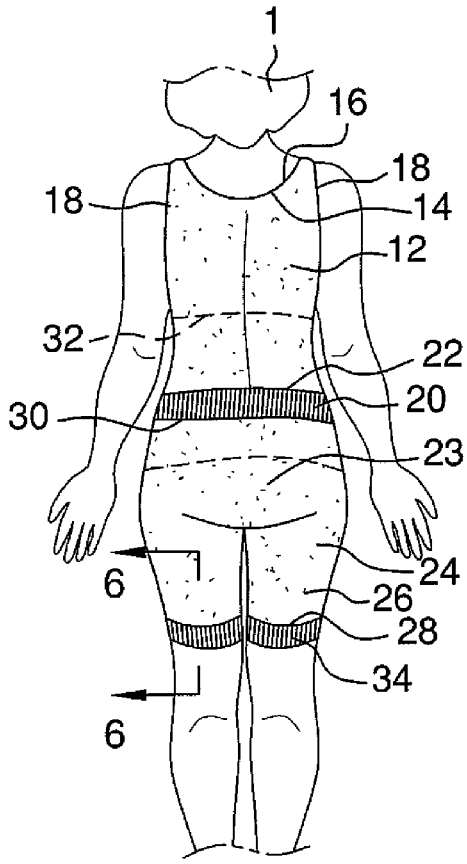
FIG. 2 is a rear view of the present invention.

With reference now to the drawings, and in particular to FIGS. 1 through 6 thereof, a new weight reducing athletic garment embodying the principles and concepts of the present invention and generally designated by the reference numeral 10 will be described.

As best illustrated in FIGS. 1 through 6, the exercise garment 10 generally comprises an upper garment section 12 being positioned over a portion of an upper torso of a person 1 when the upper garment section 12 is worn. The upper garment is worn adjacent to skin of the upper torso to inhibit the upper garment section 12 interfering with the workout. The upper garment section 12 has a top edge 14 that has a neck opening 16 and a pair of arm openings 18 therein.

A waist constricting band 20 is coupled to a bottom edge 22 of the upper garment section 12. The waist constricting band 20 constricts against the skin to secure the upper garment section 12 in position on the upper torso. The waist constricting band 20 is positioned around a waist of the person 1. The waist constricting band 20 is comprised of an elastic material to constrict against the upper torso of the person 1.

A lower garment section 23 is positioned over a lower torso and upper legs of the person 1 when the lower garment section 23 is worn by the person 1. The lower garment section 23 is worn adjacent to the skin of the lower torso and the upper legs to inhibit the lower garment section 23 interfering with the workout. The lower garment section 23 includes a pair of leg members 24 each having a lower end 26 being open and defining a leg opening 28. An upper edge 30 of the lower garment section 23 is coupled to the constricting band opposite the upper garment section 12.

An interior panel 32 is coupled to and extends between the upper garment section 12 and the lower garment section 23. The interior panel 32 extends over an abdominal area and a lower back of the upper torso and a portion of a pelvic area and a portion of a buttocks of the lower torso to increase heat retention and increase sweating during the workout. The interior panel 32 is positioned between the skin and the upper garment section 12 and the lower garment section 23. The interior panel 32 is comprised of a vinyl material to retain heat against the skin to encourage sweating.

A pair of leg constriction bands 34 is coupled to the lower garment section 23. Each of the leg openings 28 of the lower garment section 23 has one of the leg constriction bands 34 positioned adjacent thereto. Each of the leg constriction bands 34 extends around an associated one of the upper legs to maintain positioning of the lower garment section 23 on the lower torso and the upper legs of the person 1. Each of the leg constriction bands 34 is comprised of an elastic material to constrict the leg constriction bands 34 against the associated one of the upper legs.

Figure 3:
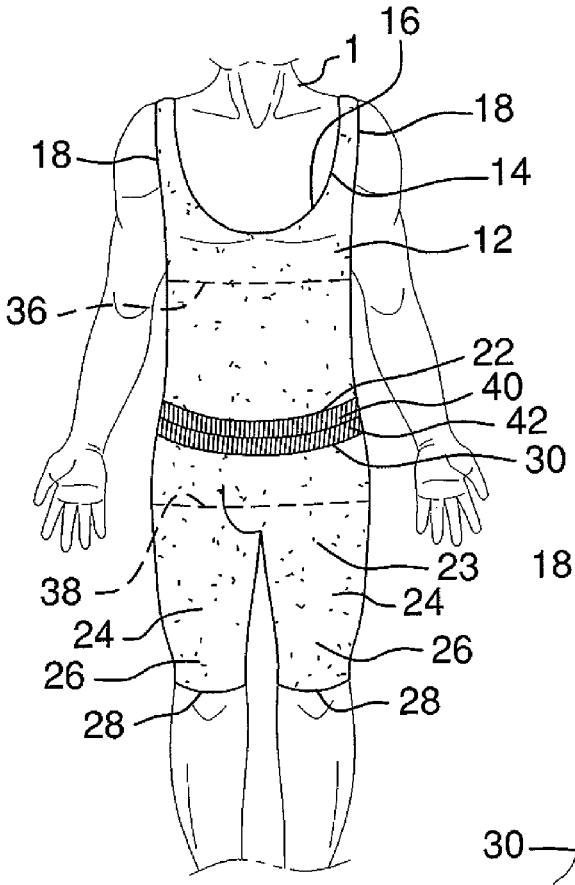
FIG. 3 is a front view of an embodiment of the present invention.
Figure 4:
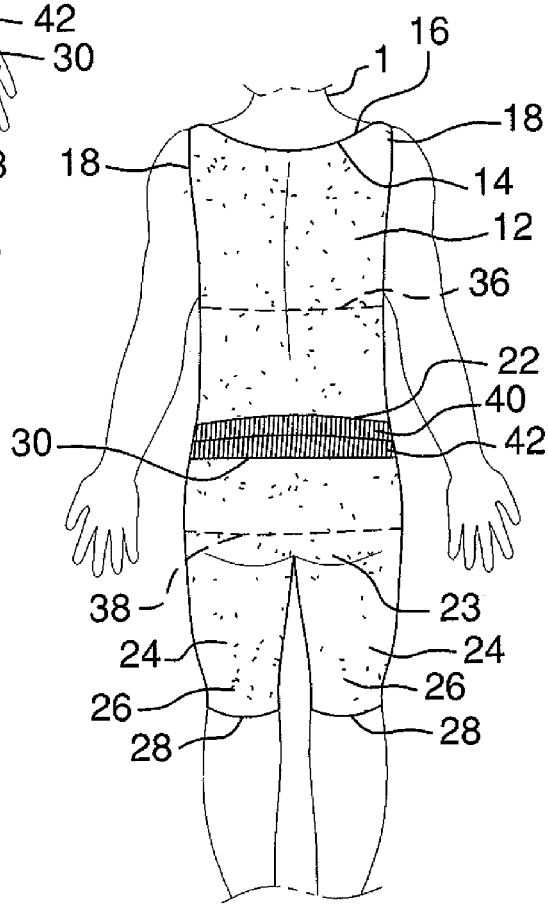
FIG. 4 is a rear view of the embodiment of the present invention shown in FIG. 3.
Figure 5:
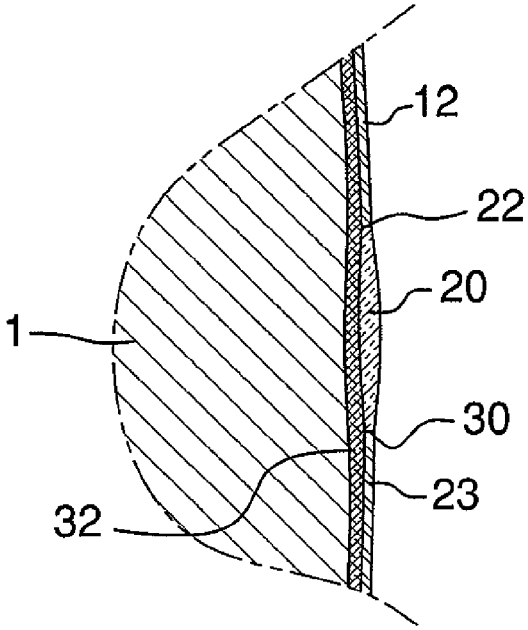
FIG. 5 is a cross-sectional view of the present invention taken along line 5-5 of FIG. 1.
Figure 6:
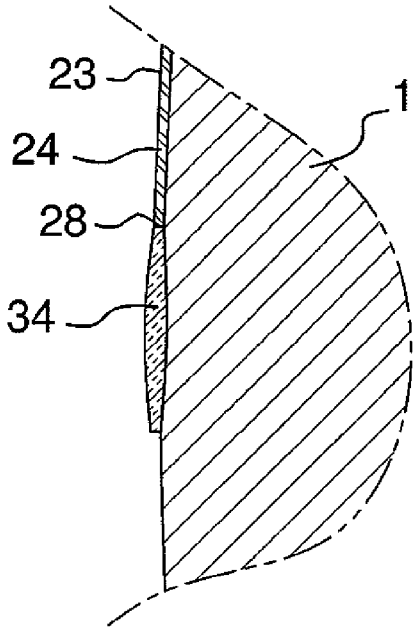
FIG. 6 is a cross-sectional view of the present invention taken along line 6-6 of FIG. 2.

In an embodiment, as shown in FIGS. 3 and 4, an upper interior panel 36 is coupled to the upper garment. The upper interior panel 36 extends over an abdominal area and a lower back of the upper torso to increase heat retention and increase sweating during the workout. The upper interior panel 36 is positioned between the skin and the upper garment section 12. A lower interior panel 38 is coupled to the lower garment section 23. The lower interior panel 38 extends over a portion of a pelvic area and a portion of buttocks of the lower torso to increase heat retention and increase sweating during the workout. The lower interior panel 38 is positioned between the skin and the upper garment section 12 and the lower garment section 23.

Additionally, the embodiment in FIGS. 3 and 4 also includes an upper waist constricting band 40 coupled to the bottom edge 22 of the upper garment section 12. The upper waist constricting band 40 constricts against the skin to secure the upper garment section 12 in position on the upper torso. The upper waist constricting band 40 is positioned around a waist of the person 1. A lower waist constricting band 42 is coupled to the upper edge 30 of the lower garment section 23. The lower waist constricting band 42 constricts against the skin to secure the lower garment section 23 in position on the lower torso. The lower waist constricting band 42 is positioned around a waist of the person 1.

In use, the upper garment section 12 and the lower garment section 23 are positioned on the torso and the upper legs the person 1. As the person 1 works out the interior panel 32 helps to retain heat around the abdominal area, the lower back, the portion of the pelvic area and the portion of the buttocks. As the heat is retained in these areas sweating of the skin is encourage to encourage greater weight loss from those areas.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise garment for encouraging sweating of a person during a workout, said garment comprising:

an upper garment section being positioned over a portion of an upper torso of the person when said upper garment section is worn;

a waist constricting band being coupled to a bottom edge of said upper garment section, said waist constricting band constricting against the skin to secure said upper garment section in position on the upper torso, said waist constricting band being positioned around a waist of the person;

a lower garment section being positioned over a lower torso and upper legs of the person when said lower garment section is worn by the person, an upper edge of said lower garment section being coupled to said constricting band opposite said upper garment section; and an interior panel being coupled to and extending between said upper garment section and said lower garment section, said interior panel extending over an abdominal area and lower back of the upper torso and a portion of a pelvic area and a portion of a buttocks of the lower torso to increase heat retention and increase sweating during the workout, said interior panel being positioned between the skin and said upper garment section and said lower garment section; wherein said upper garment section has a top edge having a neck opening and a pair of arm openings therein; and wherein said interior panel is spaced from and positioned below said arm and neck openings.

2. The garment according to claim 1, wherein said waist constricting band is comprised of an elastic material to constrict against the upper torso of the person.

3. The garment according to claim 1, wherein said lower garment section includes a pair of leg members each having a lower end being open and defining a leg opening.

4. The garment according to claim 3, further comprising a pair of leg constriction bands being coupled to said lower garment section, each of said leg openings of said lower garment section having one of said leg constriction bands positioned adjacent thereto, each of said leg constriction bands extending around an associated one of the upper legs to maintain positioning of said lower garment section on the lower torso and the upper legs of the person.

5. The garment according to claim 4, wherein each of said leg constriction bands is comprised of an elastic material to constrict the leg constriction bands against the associated one of the upper legs.

6. The garment according to claim 1, wherein said interior panel is comprised of a vinyl material to retain heat against the skin to encourage sweating.

7. An exercise garment for encouraging sweating of a person during a workout, said garment comprising:

an upper garment section being positioned over a portion of an upper torso of the person when said upper garment section is worn;

an upper interior panel being coupled to said upper garment, said upper interior panel extending over an abdominal area and lower back of the upper torso to increase heat retention and increase sweating during the workout, said upper interior panel being positioned between the skin and said upper garment section;

a lower garment section being positioned over a lower torso and upper legs of the person when said lower garment section is worn by the person; and a lower interior panel being coupled to said lower garment section, said lower interior panel extending over a portion of a pelvic area and a portion of a buttocks of the lower torso to increase heat retention and increase sweating during the workout, said lower interior panel being positioned between the skin and said upper garment section and said lower garment section;

wherein said lower garment section includes a pair of leg members each having a lower end being open and defining a leg opening; and wherein said lower section interior panel is spaced from and positioned above said leg members.

8. The garment according to claim 7, wherein said upper garment section has a top edge having a neck opening and a pair of arm openings therein.

9. The garment according to claim 7, further comprising an upper waist constricting band being coupled to a bottom edge of said upper garment section, said upper waist constricting band constricting against the skin to secure said upper garment section in position on the upper torso, said upper waist constricting band being positioned around a waist of the person.

10. The garment according to claim 7, further comprising a lower waist constricting band being coupled to an upper edge of said lower garment section, said lower waist constricting band constricting against the skin to secure said lower garment section in position on the lower torso, said lower waist constricting band being positioned around a waist of the person.

11. The garment according to claim 7, wherein said upper interior panel is comprised of a vinyl material to retain heat against the skin to encourage sweating.

12. The garment according to claim 7, wherein said lower interior panel is comprised of a vinyl material to retain heat against the skin to encourage sweating.

13. An exercise garment for encouraging sweating of a person during a workout, said garment comprising:

an upper garment section being positioned over a portion of an upper torso of the person when said upper garment section is worn, said upper garment being worn adjacent to skin of the upper torso to inhibit said upper garment section interfering with the workout, said upper garment section having a top edge having a neck opening and a pair of arm openings therein;

a waist constricting band being coupled to a bottom edge of said upper garment section, said waist constricting band constricting against the skin to secure said upper garment section in position on the upper torso, said waist constricting band being positioned around a waist of the person, said waist constricting band being comprised of an elastic material to constrict against the upper torso of the person;

a lower garment section being positioned over a lower torso and upper legs of the person when said lower garment section is worn by the person, said lower garment section being worn adjacent to the skin of the lower torso and the upper legs to inhibit said lower garment section interfering with the workout, said lower garment section including a pair of leg members each having a lower end being open and defining a leg opening, an upper edge of said lower garment section being coupled to said constricting band opposite said upper garment section;

an interior panel being coupled to and extending between said upper garment section and said lower garment section, said interior panel extending over an abdominal area and lower back of the upper torso and a portion of a pelvic area and a portion of a buttocks of the lower torso to increase heat retention and increase sweating during the workout, said interior panel being positioned between the skin and said upper garment section and said lower garment section, said interior panel being comprised of a vinyl material to retain heat against the skin to encourage sweating; and a pair of leg constriction bands being coupled to said lower garment section, each of said leg openings of said lower garment section having one of said leg constriction bands positioned adjacent thereto, each of said leg constriction bands extending around an associated one of the upper legs to maintain positioning of said lower garment section on the lower torso and the upper legs of the person, each of said leg constriction bands being comprised of an elastic material to constrict the leg constriction bands against the associated one of the upper legs; and wherein said interior panel is spaced from and positioned below said arm and neck openings.

14. The garment according to claim 13, wherein said interior panel is spaced from and positioned above said leg members.

* * * * *